US011619911B2

(12) United States Patent
Kawata et al.

(10) Patent No.: US 11,619,911 B2
(45) Date of Patent: Apr. 4, 2023

(54) TIMEPIECE MOVEMENT AND TIMEPIECE

(71) Applicant: SEIKO WATCH KABUSHIKI KAISHA, Tokyo (JP)

(72) Inventors: Masayuki Kawata, Chiba (JP); Katsuya Mugishima, Chiba (JP); Ken Sato, Chiba (JP); Yuya Tanaka, Chiba (JP)

(73) Assignee: SEIKO WATCH KABUSHIKI KAISHA, Tokyo (JP)

( * ) Notice: Subject to any disclaimer, the term of this patent is extended or adjusted under 35 U.S.C. 154(b) by 297 days.

(21) Appl. No.: 17/039,316

(22) Filed: Sep. 30, 2020

(65) Prior Publication Data

US 2021/0116867 A1 Apr. 22, 2021

(30) Foreign Application Priority Data

Oct. 17, 2019 (JP) ..... JP2019-190283
Aug. 18, 2020 (JP) ..... JP2020-138000

(51) Int. Cl.
*G04C 3/14* (2006.01)
*G04B 19/02* (2006.01)

(52) U.S. Cl.
CPC ..... *G04B 19/02* (2013.01); *G04C 3/14* (2013.01)

(58) Field of Classification Search
CPC ..... G04B 13/02; G04B 19/02; G04C 3/14
See application file for complete search history.

(56) References Cited

U.S. PATENT DOCUMENTS 6,088,300 A * 7/2000 Nakajima ..... G04C 3/12 368/37
11,237,521 B2 * 2/2022 Kawata ..... G04C 3/143
2014/0029387 A1 * 1/2014 Matsuo ..... G04B 19/24 368/37
2017/0322519 A1 * 11/2017 Lagorgette ..... G04C 3/143
2019/0219969 A1 * 7/2019 Kawata ..... G04B 19/02

FOREIGN PATENT DOCUMENTS

JP 2019-124681 A 7/2019

OTHER PUBLICATIONS

Extended European Search Report in Europe Application No. 20202233.1, dated Mar. 15, 2021, 7 pages.

* cited by examiner

*Primary Examiner* — Sean Kayes
(74) *Attorney, Agent, or Firm* — Crowell & Moring LLP

(57) ABSTRACT

A timepiece includes a first motor having a rotor for rotating a hour hand, and a first train wheel group having a wheel gear rotating based on rotation of the rotor. The first train wheel group includes a third intermediate hour pinion, a first intermediate hour pinion, a twenty four hour wheel gear having a first reference load unit disposed to mesh with the third intermediate hour pinion so that a load received by the rotor fluctuates in a case where the twenty four hour wheel gear meshes with the third intermediate hour pinion, and rotating at a first reduction ratio with respect to the rotor, and a second intermediate hour wheel gear having a second reference load unit disposed to mesh with the first intermediate hour pinion so that the load received by the rotor fluctuates in a case where the second intermediate hour wheel gear meshes with the first intermediate hour pinion, and rotating at a second reduction ratio lower than the first reduction ratio with respect to the rotor.

8 Claims, 8 Drawing Sheets

TIMEPIECE MOVEMENT AND TIMEPIECE

RELATED APPLICATIONS

This application claims priority to Japanese Patent Application Nos. 2019-190283, filed on Oct. 17, 2019, and JP2020-138000, filed on Aug. 18, 2020, the entire contents of which are incorporated herein by reference.

BACKGROUND OF THE INVENTION

1. Field of the Invention

The present invention relates to a timepiece movement and a timepiece.

2. Description of the Related Art

As a method of detecting a position of an indicating hand in a timepiece, a technique for determining a reference position of an indicating hand is known as follows. A train wheel is formed so that a load fluctuation occurs in a rotor of a stepping motor when the indicating hand is located at the reference position, and a rotating state of the rotor is detected by using an induced voltage. As an example of a mechanism for causing the load fluctuation corresponding to the reference position of the indicating hand to occur in the motor, a method has been developed in which one tooth of a predetermined wheel gear rotating in conjunction with the indicating hand is formed in a shape different from a shape of other teeth. In this manner, the load fluctuation occurs in the rotor when the one tooth meshes with other wheel gears (for example, refer to JP-A-2019-124681).

However, for example, when the wheel gear that causes the load fluctuation to occur is the wheel gear that has a relatively high reduction ratio with respect to the rotor, in some cases, a plurality of hand operation steps may be required until the load fluctuation is completed from when the load fluctuation starts. In this case, a magnitude of a load detected by using the induced voltage of the motor fluctuates depending on a driving voltage of the motor or a magnitude of a driving pulse. Consequently, in some cases, it may be difficult to detect the reference position of the indicating hand.

SUMMARY OF THE INVENTION

It is an aspect of the present application to provide a timepiece movement and a timepiece which are capable of accurately detecting the reference position of the indicating hand.

According to the present application, there is provided a timepiece movement including a stepping motor having a rotor for rotating an indicating hand, and a train wheel group having a wheel gear rotating based on rotation of the rotor. The train wheel group includes a first wheel gear, a second wheel gear, a third wheel gear having a first reference load unit disposed to mesh with the first wheel gear so that a load received by the rotor fluctuates in a case where the first reference load unit meshes with the first wheel gear, and rotating at a first reduction ratio with respect to the rotor, and a fourth wheel gear having a second reference load unit disposed to mesh with the second wheel gear so that the load received by the rotor fluctuates in a case where the second reference load unit meshes with the second wheel gear, and rotating at a second reduction ratio lower than the first reduction ratio with respect to the rotor.

According to the present application, the fourth wheel gear having the second reference load unit rotates more than the third wheel gear having the first reference load unit, each time the rotor rotates one step. Therefore, a frequency at which the second reference load unit and the second wheel gear mesh with each other is higher than a frequency at which the first reference load unit and the first wheel gear mesh with each other. In this manner, the second reference load unit causes a load received by the rotor to fluctuate at a higher frequency than the first reference load unit.

Here, since the first reduction ratio is relatively high, in some cases, the first reference load unit may mesh with the first wheel gear over a plurality of steps of rotation of the rotor. In this case, the load received by the rotor fluctuates over the plurality of steps of the rotation of the rotor due to the first reference load unit. Accordingly, there is a possibility that the reference position of the indicating hand rotating in synchronization with the third wheel gear may be unlikely to be determined by detecting only the load fluctuation caused by the first reference load unit.

Therefore, the reference position of the indicating hand can be accurately determined by combining a low frequency load fluctuation caused by the first reference load unit with a high frequency load fluctuation caused by the second reference load unit.

Therefore, the reference position of the indicating hand can be accurately detected.

In the timepiece movement, the train wheel group may have a wheel to which the indicating hand is attached, and which rotates at a third reduction ratio with respect to the rotor. The first reduction ratio may be a multiple of the third reduction ratio.

According to the present application, the indicating hand can be rotated once, each time the third wheel gear is rotated by an integer number of rounds. Therefore, the indicating hand can be located at the same position every time, at any timing at which the first reference load unit meshes with the first wheel gear. Therefore, it is possible to accurately determine the reference position of the indicating hand.

In the timepiece movement, the first reduction ratio may be a multiple of the second reduction ratio.

According to the present application, the third wheel gear can be rotated once, each time the fourth wheel gear is rotated by the integer number of rounds. Therefore, a timing at which the load fluctuation occurs due to the second reference load unit can be fixedly set with respect to a timing at which the load fluctuation occurs due to the first reference load unit. Therefore, the reference position of the indicating hand can be easily determined by combining the load fluctuation caused by the first reference load unit with the load fluctuation caused by the second reference load unit.

In the timepiece movement, the second reference load unit may be provided in one tooth of the fourth wheel gear. The number of steps of the stepping motor which is required for rotating the fourth wheel gear once may be equal to the number of teeth of the fourth wheel gear.

According to the present application, a period during which the second reference load unit meshes with the second wheel gear so that the load received by the rotor fluctuates is a period of approximately one step of the stepping motor. In this manner, the second reference load unit causes the load fluctuation to occur for only a period of approximately one step of the stepping motor, while the fourth wheel gear rotates once. Therefore, the reference position of the indicating hand can be more accurately determined. In addition, it is possible to more freely adopt a train wheel configuration.

In the timepiece movement, the train wheel group may have a train wheel for transmitting the rotation of the rotor to at least one of the indicating hand and a display wheel for displaying information. The train wheel may include the third wheel gear and the fourth wheel gear.

According to the present application, the wheel gear that transmits the rotation of the rotor to at least one of the indicating hand and the display wheel can be used as the third wheel gear and the fourth wheel gear. Therefore, the timepiece movement that achieves the above-described operational effect can be formed without increasing the number of wheel gears.

In the timepiece movement, the train wheel group may have a train wheel for transmitting the rotation of the rotor to at least one of the indicating hand and a display wheel for displaying information. At least one of the third wheel gear and the fourth wheel gear may be provided separately from a wheel gear included in the train wheel.

According to the present application, at least one of the third wheel gear and the fourth wheel gear is provided separately from the wheel gear that transmits the rotation of the rotor to at least one of the indicating hand and the display wheel. Therefore, the timepiece movement that achieves the above-described operational effect can be formed without changing a configuration of the train wheel in the related art.

In the timepiece movement, the first reference load unit may elastically deform by coming into contact with the first wheel gear. The second reference load unit may elastically deform by coming into contact with the second wheel gear.

According to the present application, the first reference load unit comes into contact with the first wheel gear, and elastically deforms. Accordingly, energy loss occurs in the train wheel group due to the elastic deformation. In addition, the second reference load unit comes into contact with the second wheel gear, and elastically deforms. Accordingly, the energy loss occurs in the train wheel group due to the elastic deformation. The energy loss occurs in the train wheel group, thereby increasing the load received by the rotor. Therefore, it is possible to form the first reference load unit and the second reference load unit which cause the load received by the rotor to fluctuate.

According to the present application, there is provided a timepiece including the timepiece movement.

According to the present application, it is possible to provide the timepiece that can accurately recognize a position of the indicating hand.

According to the present application, it is possible to provide the timepiece movement and the timepiece which are capable of accurately detecting the reference position of the indicating hand.

DETAILED DESCRIPTION OF THE PREFERRED EMBODIMENTS

Figure 1:
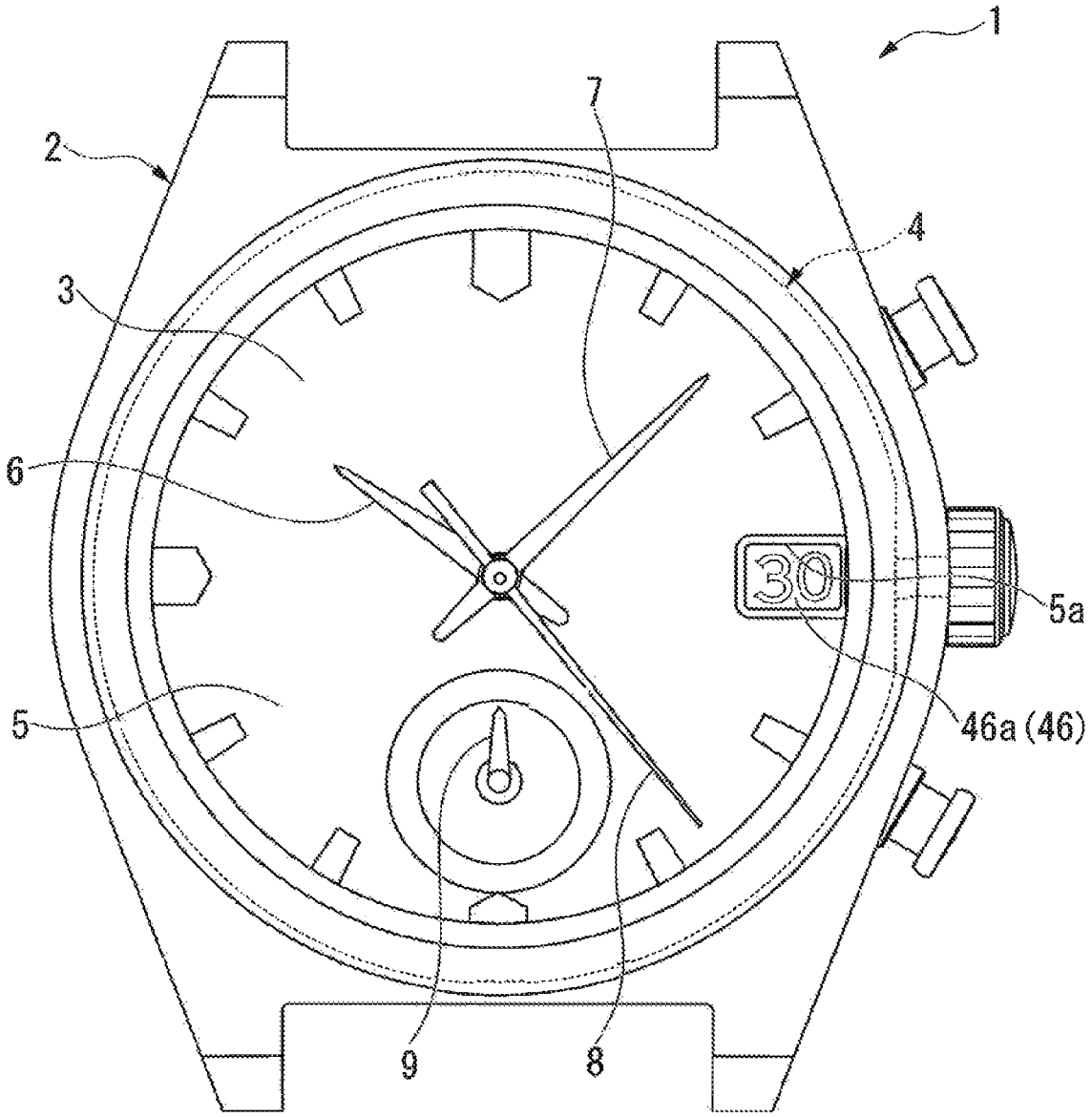
FIG. 1 is an external view of a timepiece which illustrates a first embodiment.

Hereinafter, embodiments of the present invention will be described with reference to the drawings. In the following description, the same reference numerals will be assigned to configurations having the same or similar functions. Then, repeated description of those configurations may be omitted in some cases.

First Embodiment

In general, a mechanical body including a driving part of a timepiece is referred to as a "movement". A state where a dial and hands are attached to the movement and the movement is put into a timepiece case to prepare a finished product is referred to as a "complete state" of the timepiece. Out of both sides of a main plate configuring a substrate of the timepiece, a side on which a glass of the timepiece case is present (that is, a side on which the dial is present) is referred to as a "back side" of the movement. In addition, out of both sides of the main plate, a side on which a case back cover of the timepiece case is present (that is, a side opposite to the dial) is referred to as a "front side" of the movement.

FIG. 1 is an external view of a timepiece which illustrates a first embodiment.

As illustrated in FIG. 1, in the complete state of a timepiece 1 according to the present embodiment, a timepiece case 2 having a case back cover (not illustrated) and a glass 3 internally includes a movement 4 (timepiece movement), a dial 5 having a scale, an hour hand 6 (indicating hand), a minute hand 7, a second hand 8 (indicating hand), and a twenty four hour hand 9. A date window **5*a* for indicating a date character 46*a* displayed on a date indicator 46 (display wheel) to be described later is open in the dial 5. In this manner, the timepiece 1** enables a user to confirm a date in addition to a time.

Figure 2:
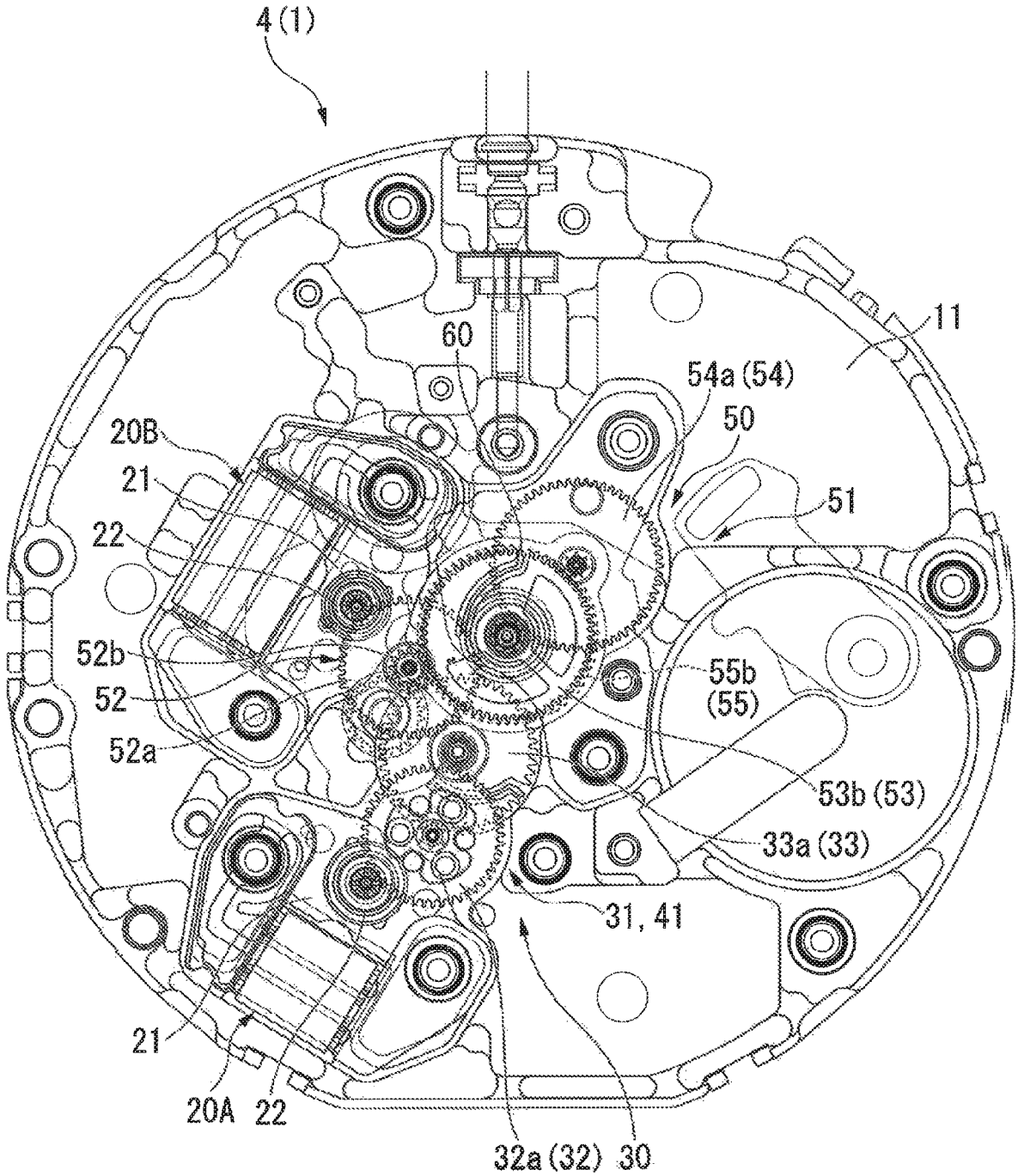
FIG. 2 is a plan view of a front side of a movement according to the first embodiment.
Figure 3:
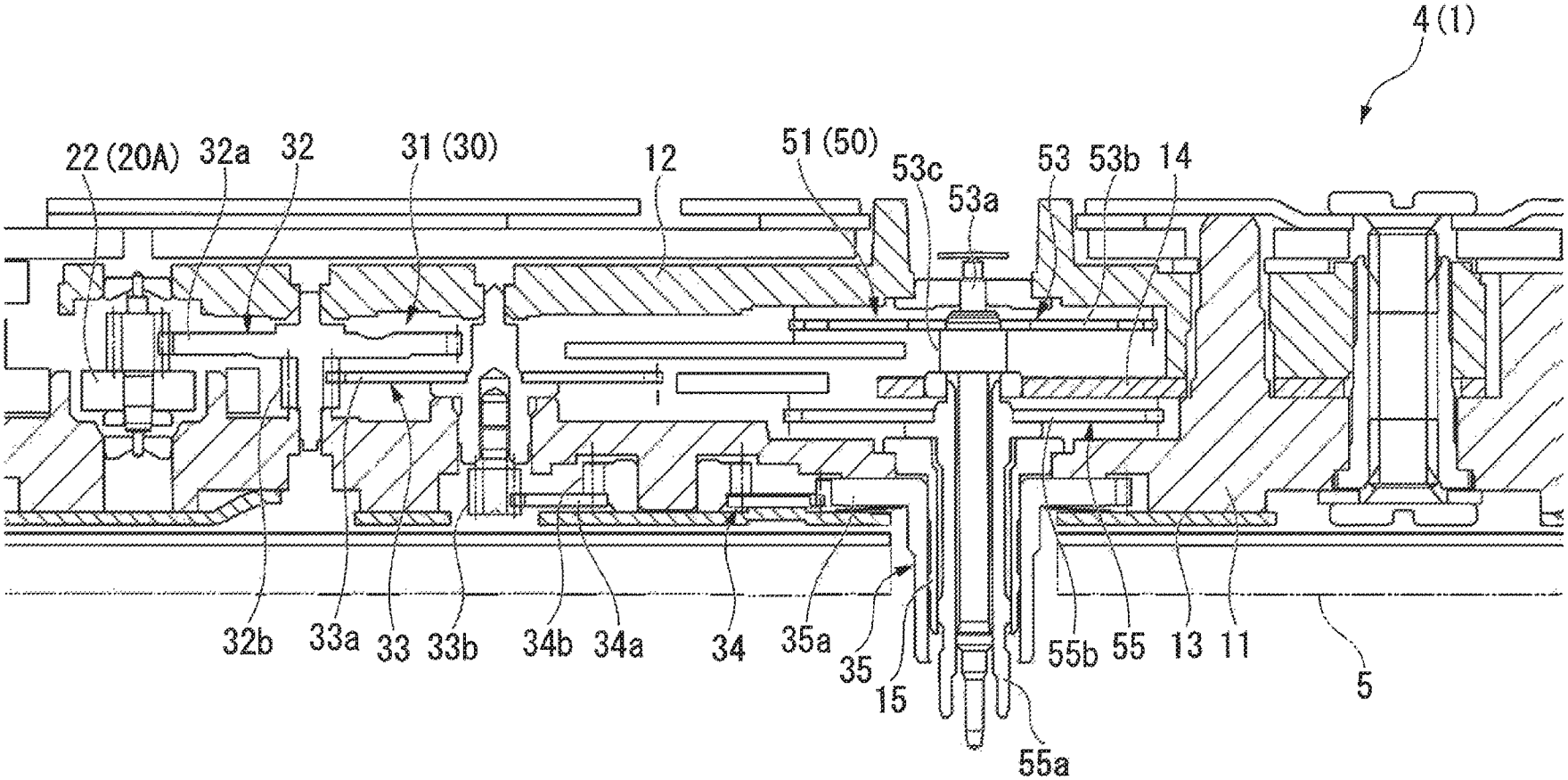
FIG. 3 is a sectional view of the movement according to the first embodiment.

FIG. 2 is a plan view of the front side of the movement of a first embodiment. FIG. 3 is a sectional view of the movement according to the first embodiment.

As illustrated in FIGS. 2 and 3, the movement 4 mainly includes a main plate 11, a train wheel bridge 12, a date indicator maintaining plate 13, a center wheel bridge 14, a first motor 20A, a second motor 20B, a first train wheel group 30, and a second train wheel group 50.

As illustrated in FIG. 3, the main plate 11 configures the substrate of the movement 4. The train wheel bridge 12 is disposed on the front side of the main plate 11. The date indicator maintaining plate 13 is disposed on the back side of the main plate 11. The center wheel bridge 14 is disposed between the main plate 11 and the train wheel bridge 12.

As illustrated in FIG. 2, the first motor 20A and the second motor 20B are stepping motors each having a stator 21 and a rotor 22. The number of magnetic poles of the rotor 22 is two. Each of the first motor 20A and the second motor 20B rotates the rotor 22 by 180° in one step. The first motor 20A generates power for rotating the hour hand 6, the twenty four hour hand 9, and the date indicator 46 (refer to FIG. 1 for all). The first motor 20A rotates the rotor 22 one step every minute. The second motor 20B generates power for rotating the minute hand 7 and the second hand 8 (refer to FIG. 1 for all). The second motor 20B rotates the rotor 22 two steps every second. A pinion is formed in each rotor 22 of the first motor 20A and the second motor 20B.

Figure 4:
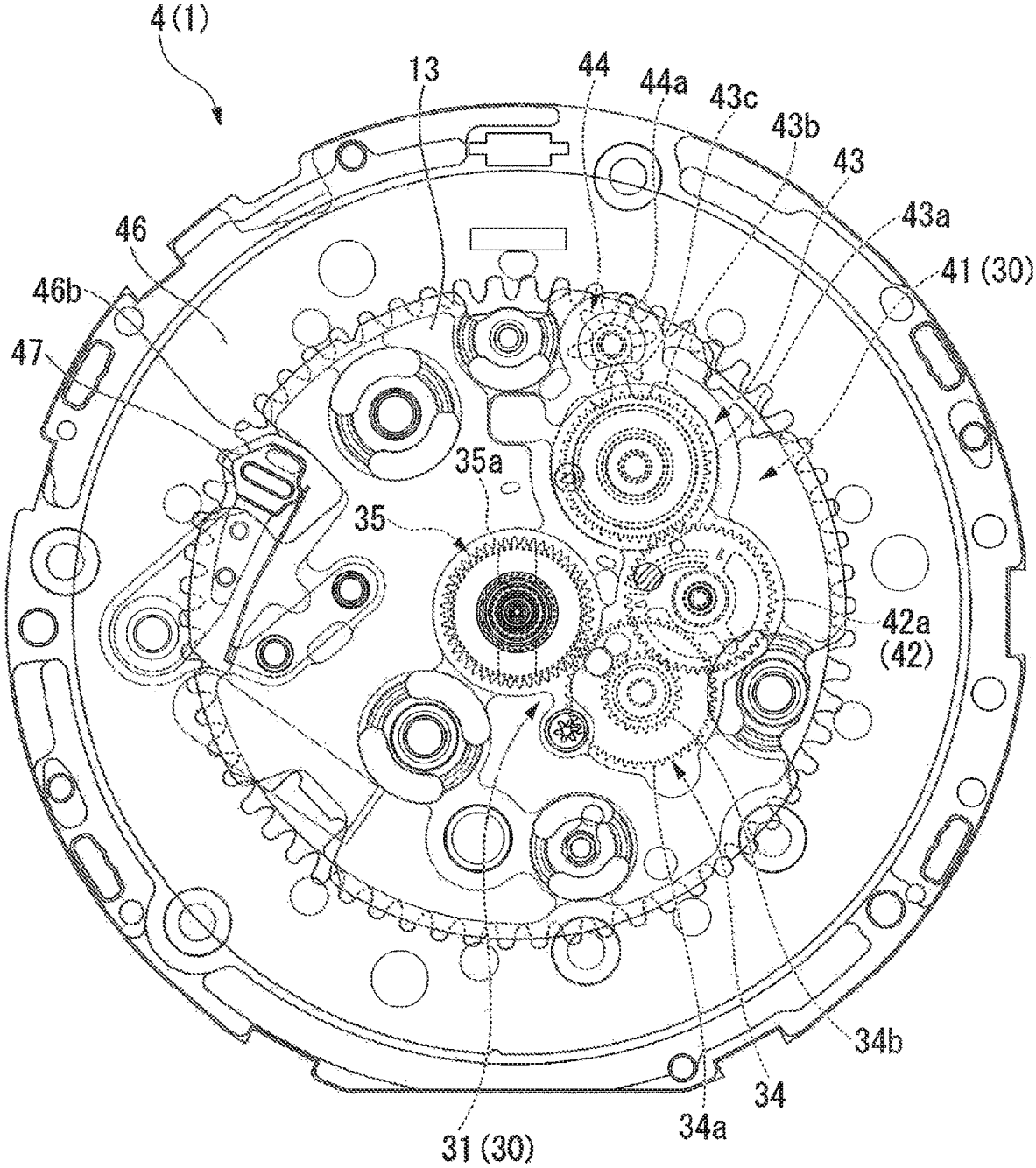
FIG. 4 is a plan view of a back side of the movement according to the first embodiment.
Figure 5:
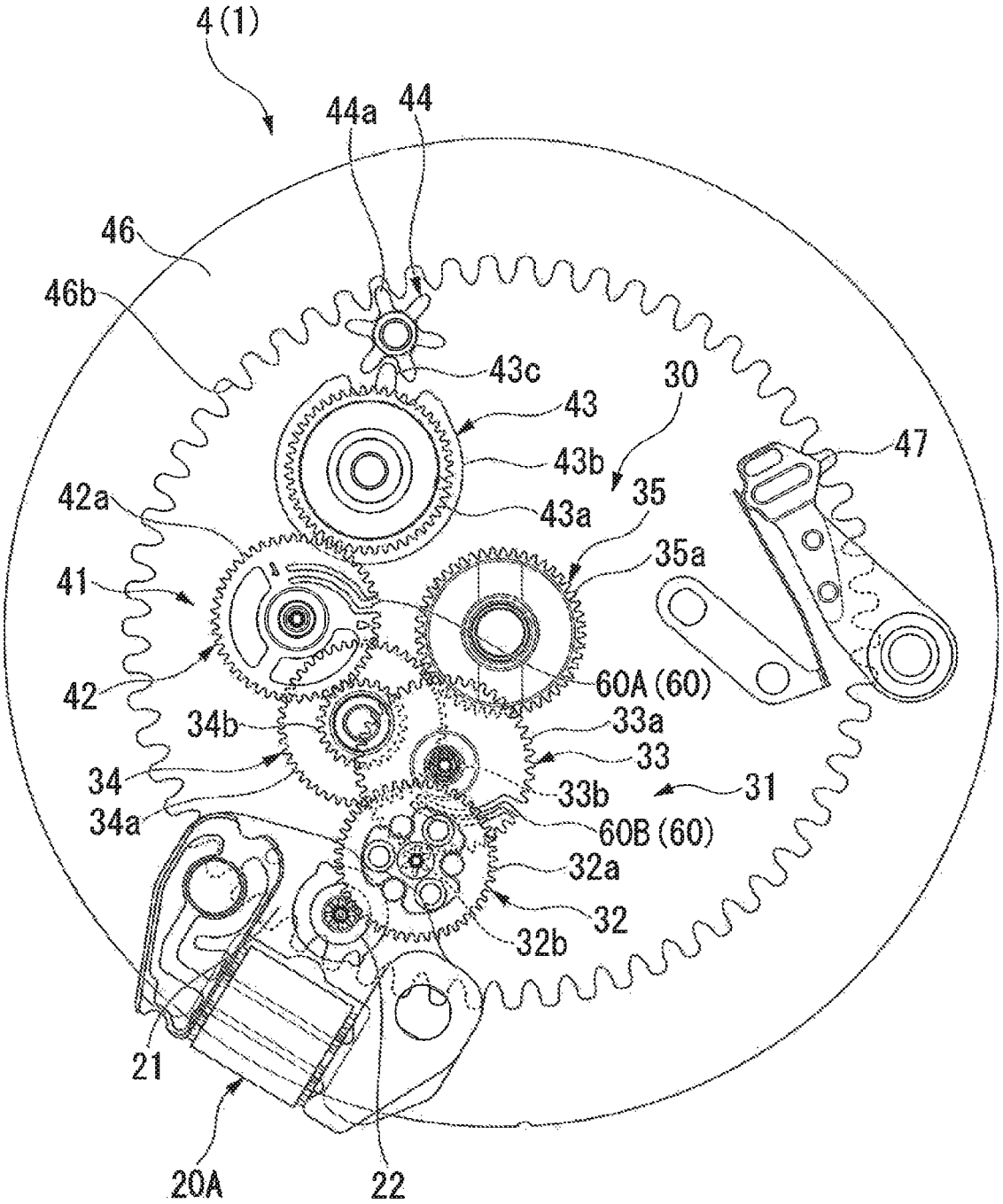
FIG. 5 is a plan view illustrating a part of the movement according to the first embodiment, and is a view when a first train wheel group is viewed from the front side.

FIG. 4 is a plan view of the back side of the movement according to the first embodiment. FIG. 5 is a plan view illustrating a part of the movement according to the first embodiment, and is a view when a first train wheel group is viewed from the front side.

As illustrated in FIGS. 4 and 5, the first train wheel group 30 has a wheel gear rotating based on the rotation of the rotor 22 of the first motor 20A. The first train wheel group 30 includes an hour train wheel 31 that transmits the rotation of the rotor 22 of the first motor 20A to the hour hand 6, and a calendar train wheel 41 that transmits the rotation of the rotor 22 of the first motor 20A to the twenty four hour hand 9 and the date indicator 46.

As illustrated in FIGS. 3 and 5, the hour train wheel 31 has a first intermediate hour wheel 32, a second intermediate hour wheel 33, a third intermediate hour wheel 34, and an hour wheel 35.

The first intermediate hour wheel 32 is supported to be rotatable by the main plate 11 and the train wheel bridge 12. The first intermediate hour wheel 32 has a first intermediate hour wheel gear 32*a* and a first intermediate hour pinion 32*b*. The first intermediate hour wheel gear 32*a* meshes with a pinion of the rotor 22 of the first motor 20A between the main plate 11 and the train wheel bridge 12. The first intermediate hour wheel 32 rotates at a reduction ratio of 6 with respect to the rotor 22. That is, the first intermediate hour wheel 32 rotates once, each time the rotor 22 of the first motor 20A rotates six times.

The second intermediate hour wheel 33 is supported to be rotatable by the main plate 11 and the train wheel bridge 12. The second intermediate hour wheel 33 has a second intermediate hour wheel gear 33*a* and a second intermediate hour pinion 33*b*. The second intermediate hour wheel gear 33*a* meshes with the first intermediate hour pinion 32*b* of the first intermediate hour wheel 32 between the main plate 11 and the train wheel bridge 12. The second intermediate hour wheel 33 is a driven wheel gear with respect to the first intermediate hour wheel 32. The second intermediate hour wheel 33 rotates at the reduction ratio of 7.5 with respect to the first intermediate hour wheel 32. That is, the second intermediate hour wheel 33 rotates at the reduction ratio of 45 with respect to the rotor 22 of the first motor 20A.

The third intermediate hour wheel 34 is supported to be rotatable by the main plate 11 between the main plate 11 and the date indicator maintaining plate 13. The third intermediate hour wheel 34 has a third intermediate hour wheel gear 34*a* and a third intermediate hour pinion 34*b*. The third intermediate hour wheel gear 34*a* meshes with the second intermediate hour pinion 33*b* of the second intermediate hour wheel 33 on the back side of the main plate 11. The third intermediate hour wheel 34 is a driven wheel gear with respect to the second intermediate hour wheel 33. The third intermediate hour wheel 34 rotates at the reduction ratio of 8 with respect to the second intermediate hour wheel 33. That is, the third intermediate hour wheel 34 rotates at the reduction ratio of 360 with respect to the rotor 22 of the first motor 20A.

The hour wheel 35 is externally inserted into a center tube 15 to be rotatable on the back side of the main plate 11. The center tube 15 is held by the main plate 11. The center tube 15 protrudes to the back side from the main plate 11. The hour wheel 35 is pressed by the date indicator maintaining plate 13 from the back side via a dial washer. An end portion on the back side of the hour wheel 35 protrudes to the back side from the date indicator maintaining plate 13. The hour hand 6 (refer to FIG. 1) is attached to an end portion on the back side of the hour wheel 35. The hour wheel 35 has an hour wheel gear 35*a*. The hour wheel gear 35*a* meshes with the third intermediate hour wheel gear 34*a* of the third intermediate hour wheel 34. The hour wheel 35 is a driven wheel gear with respect to the third intermediate hour wheel 34. The hour wheel 35 rotates at the reduction ratio of 1 with respect to the third intermediate hour wheel 34. That is, the hour wheel 35 rotates at the reduction ratio of 360 with respect to the rotor 22 of the first motor 20A.

As illustrated in FIG. 5, the calendar train wheel 41 includes the first intermediate hour wheel 32, the second intermediate hour wheel 33, and the third intermediate hour wheel 34 which are described above, a twenty four hour wheel 42, and an intermediate date wheel 43.

The twenty four hour wheel 42 is supported to be rotatable by the main plate 11 between the main plate 11 and the date indicator maintaining plate 13. An axle portion of the twenty four hour wheel 42 protrudes to the back side from the date indicator maintaining plate 13. The twenty four hour hand 9 (refer to FIG. 1) is attached to an end portion on the back side of the axle portion. The twenty four hour wheel 42 has a twenty four hour wheel gear 42*a*. The twenty four hour wheel gear 42*a* meshes with the third intermediate hour pinion 34*b* of the third intermediate hour wheel 34 on the back side of the main plate 11. The twenty four hour wheel 42 is a driven wheel gear with respect to the third intermediate hour wheel 34. The twenty four hour wheel 42 rotates at the reduction ratio of 2 with respect to the third intermediate hour wheel 34. That is, the twenty four hour wheel 42 rotates at the reduction ratio of 720 with respect to the rotor 22 of the first motor 20A.

The intermediate date wheel 43 is supported to be rotatable by the main plate 11 between the main plate 11 and the date indicator maintaining plate 13. A rotation center of the intermediate date wheel 43 is provided at a position shifted at an angle smaller than 1800 from a rotation center of the third intermediate hour wheel 34 around a rotation center of the twenty four hour wheel 42. That is, the rotation center of the intermediate date wheel 43 is provided at a position deviated from a straight line passing through the rotation center of the twenty four hour wheel 42 and the rotation center of the third intermediate hour wheel 34 in a plan view. The intermediate date wheel 43 has an intermediate date indicator wheel gear 43*a* and a disc wheel 43*b*. The intermediate date indicator wheel gear 43*a* meshes with the twenty four hour wheel gear 42*a* on the back side of the main plate 11. The intermediate date wheel 43 is a driven wheel with respect to the twenty four hour wheel 42. The intermediate date wheel 43 rotates at the reduction ratio of 1 with respect to the twenty four hour wheel 42. That is, the intermediate date wheel 43 rotates at the reduction ratio of 720 with respect to the rotor 22 of the first motor 20A. The disc wheel 43*b* overlaps the intermediate date indicator wheel gear 43*a*. The disc wheel 43*b* includes a feed dog 43*c*. The feed dog 43*c* protrudes outward in a radial direction from an outer peripheral surface of the disc wheel 43*b*.

A date indicator driving wheel 44 is supported to be rotatable by the main plate 11 between the main plate 11 and the date indicator maintaining plate 13. The date indicator driving wheel 44 has a date indicator driving wheel gear 44*a*. The date indicator driving wheel gear 44*a* is formed to be capable of meshing with the feed dog 43*c* of the intermediate date wheel 43. The date indicator driving wheel 44 rotates when the feed dog 43*c* of the intermediate date wheel 43 enters a rotation trajectory of the date indicator driving wheel gear 44*a* and meshes with the date indicator driving wheel gear 44*a*. Therefore, the date indicator driving wheel 44 is intermittently rotated by the rotation of the intermediate date wheel 43. The date indicator driving wheel 44 rotates the date indicator 46.

The date indicator 46 is a ring-shaped member attached to the main plate 11 to be rotatable. The date indicator 46 is pressed from the back side by the date indicator maintaining plate 13 (refer to FIG. 4). The date character 46*a* (refer to FIG. 1) which is date information is displayed along a circumferential direction on the back surface of the date indicator 46. The date indicator 46 displays the date information by exposing the date character 46*a* through the date window 5*a* of the dial 5. A plurality of internal teeth 46*b* are formed over an entire periphery on an inner peripheral edge of the date indicator 46. The internal teeth 46*b* mesh with the date indicator driving wheel gear 44*a*. The date indicator 46 rotates in conjunction with the rotation of the date indicator driving wheel 44. Therefore, the date indicator 46 is intermittently rotated by the rotation of the intermediate date wheel 43. A position of the date indicator 46 in a rotation direction is regulated by a jumper 47. The jumper 47 restricts the rotation of the date indicator 46 by engaging a tip claw with the internal teeth 46*b* of the date indicator 46.

As illustrated in FIGS. 2 and 3, the second train wheel group 50 has a wheel gear rotating based on the rotation of the rotor 22 of the second motor 20B. The second train wheel group 50 includes a going train wheel 51 that transmits the rotation of the rotor 22 of the second motor 20B to the second hand 8 and the minute hand 7 (refer to FIG. 1 for all). The going train wheel 51 includes an intermediate second wheel 52, a second wheel & pinion 53, a third wheel & pinion 54, and a center wheel & pinion 55.

The intermediate second wheel 52 is supported to be rotatable by the main plate 11. The intermediate second wheel 52 has an intermediate second wheel gear 52*a* and an intermediate second pinion 52*b*. The intermediate second wheel gear 52*a* meshes with a pinion of the rotor 22 of the second motor 20B between the main plate 11 and the train wheel bridge 12. The intermediate second wheel 52 rotates at the reduction ratio of 6 with respect to the rotor 22 of the second motor 20B.

The second wheel & pinion 53 is supported to be rotatable by the train wheel bridge 12. The second wheel & pinion 53 has a second wheel stem 53*a*, a second wheel 53*b* assembled to the second wheel stem 53*a*, and a second pinion 53*c* formed in the second wheel stem 53*a*. The second wheel stem 53*a* is inserted into a center wheel stem 55*a* (to be described later). The second wheel stem 53*a* protrudes to the back side from the center wheel stem 55*a*. The second hand 8 (refer to FIG. 1) is attached to an end portion on the back side of the second wheel stem 53*a*. The second wheel 53*b* meshes with the intermediate second pinion 52*b*. The second wheel & pinion 53 is a driven wheel gear with respect to the intermediate second wheel 52. The second wheel & pinion 53 rotates at the reduction ratio of 10 with respect to the intermediate second wheel 52. That is, the second wheel & pinion 53 rotates at the reduction ratio of 60 with respect to the rotor 22 of the second motor 20B.

The third wheel & pinion 54 is supported to be rotatable by the main plate 11 and the train wheel bridge 12. The third wheel & pinion 54 includes a third wheel 54*a* and a third pinion (not illustrated). The third wheel 54*a* meshes with the second pinion 53*c*. The third wheel & pinion 54 is a driven wheel gear with respect to the second wheel & pinion 53. The third wheel & pinion 54 rotates at the reduction ratio of 20 with respect to the second wheel & pinion 53. That is, the third wheel & pinion 54 rotates at the reduction ratio of 400 with respect to the rotor 22 of the second motor 20B.

The center wheel & pinion 55 is supported to be rotatable by the center wheel bridge 14 and the center tube 15. The center wheel & pinion 55 has a center wheel stem 55*a* and a center wheel 55*b* assembled to the center wheel stem 55*a*. The center wheel stem 55*a* is formed in a cylindrical shape, and is inserted into the center tube 15. The center wheel stem 55*a* protrudes to the back side from the hour wheel 35. The minute hand 7 (refer to FIG. 1) is attached to an end portion on the back side of the center wheel stem 55*a*. The center wheel 55*b* meshes with the third pinion. The center wheel & pinion 55 is a driven wheel gear with respect to the third wheel & pinion 54. The center wheel & pinion 55 rotates at the reduction ratio of 9 with respect to the third wheel & pinion 54. That is, the center wheel & pinion 55 rotates at the reduction ratio of 3,600 with respect to the rotor 22 of the second motor 20B.

As illustrated in FIG. 5, a reference load unit 60 is provided in two wheel gears of a plurality of wheel gears included in the first train wheel group 30. The twenty four hour wheel gear 42*a* has a first reference load unit 60A. The second intermediate hour wheel gear 33*a* has a second reference load unit 60B. The first reference load unit 60A and the second reference load unit 60B are each formed in the same manner. Thus, hereinafter, the second reference load unit 60B will be described, and detailed description relating to a configuration of the first reference load unit 60A will be omitted.

Figure 6:
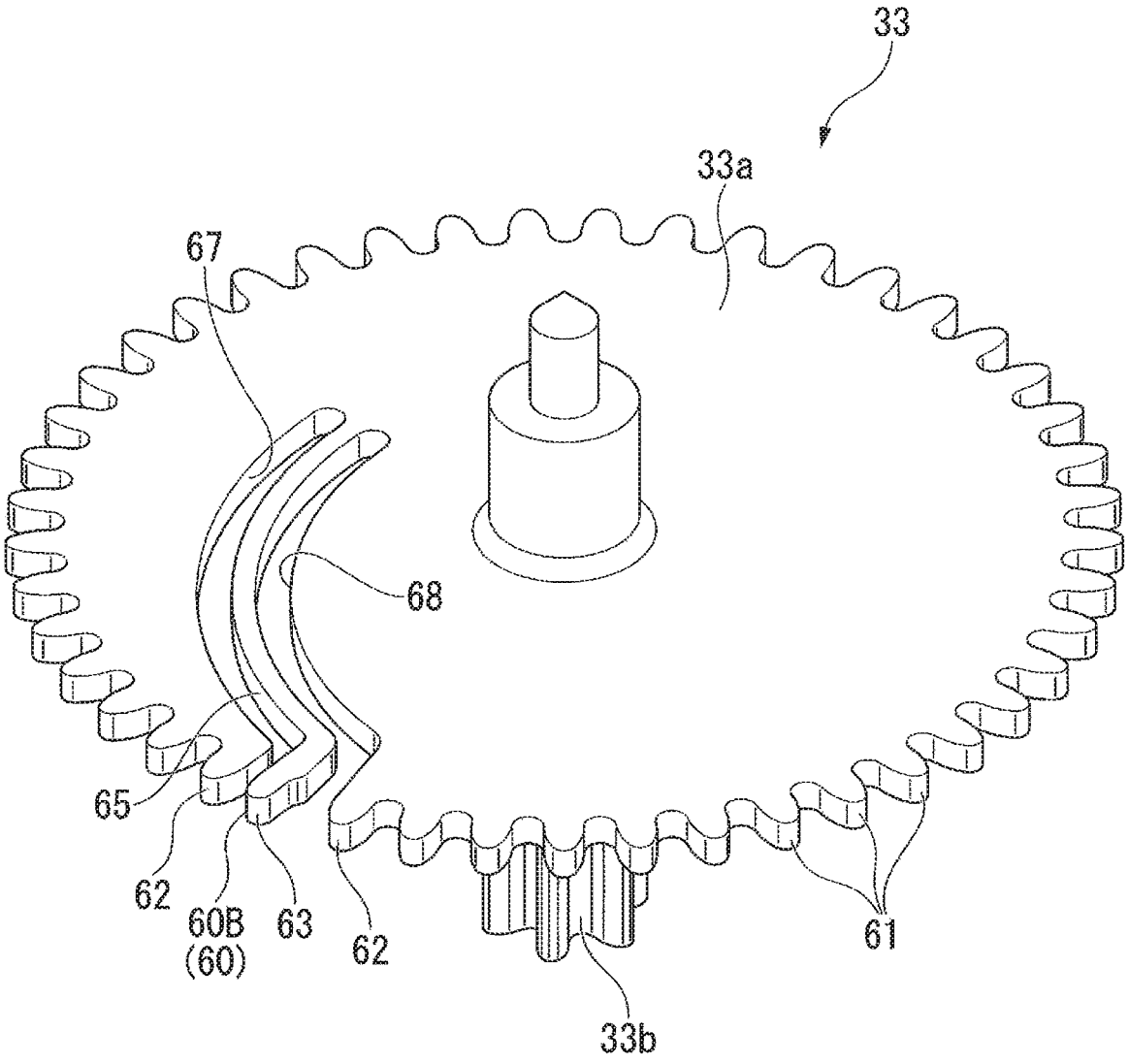
FIG. 6 is a perspective view of a second intermediate hour wheel according to the first embodiment.

FIG. 6 is a perspective view of the second intermediate hour wheel according to the first embodiment.

As illustrated in FIG. 6, the second intermediate hour wheel gear 33*a* includes a plurality of teeth 61 and an elastic portion 65. The plurality of teeth 61 include standard teeth 62 and an elastic tooth 63 serving as the second reference load unit 60B. The standard teeth 62 are all teeth of the plurality of teeth 61 excluding the elastic tooth 63. The standard teeth 62 are teeth of a general wheel gear, and are teeth formed in an arc tooth profile, an involute tooth profile, or a cycloid tooth profile. The elastic tooth 63 is one tooth of the plurality of teeth 61 included in the second intermediate hour wheel gear 33*a*. The elastic tooth 63 is formed to be elastically displaceable.

The elastic portion 65 is a cantilever beam whose tip has the elastic tooth 63, and which is formed to be flexibly deformable. The elastic portion 65 is a portion between a first slit 67 and a second slit 68 which are formed in the second intermediate hour wheel gear 33*a*. The first slit 67 extends inward in the radial direction from one tooth groove adjacent to the elastic tooth 63, and thereafter, extends toward one side in the circumferential direction. The second slit 68 extends along the first slit 67 from the other tooth groove adjacent to the elastic tooth 63. In this manner, the elastic portion 65 extends to have a substantially constant width, and is formed to be elastically deformable so that the elastic tooth 63 of the tip is displaced in the radial direction.

An operation of the reference load unit 60 will be described.

As illustrated in FIGS. 5 and 6, when, out of the plurality of teeth 61 of the second intermediate hour wheel gear 33*a*, the tooth engaging with the first intermediate hour pinion 32*b* is switched from the standard tooth 62 to the elastic tooth 63, the tooth of the first intermediate hour pinion 32*b* comes into contact with the elastic tooth 63. Thereafter, when the first intermediate hour pinion 32*b* further rotates, the elastic tooth 63 is displaced inward in the radial direction while the elastic deformation of the elastic portion 65 is caused by the elastic tooth 63. In this manner, energy loss occurs in the first train wheel group 30 due to the elastic deformation of the elastic portion 65. Therefore, in a case where the elastic tooth 63 meshes with the first intermediate hour pinion 32*b*, the elastic tooth 63 increase a load received by the rotor 22 of the first motor 20A, compared to a case where the standard tooth 62 meshes with the first intermediate hour pinion 32*b*. That is, the second reference load unit 60B causes the load received by the rotor 22 of the first motor 20A to fluctuate once, each time the second intermediate hour wheel 33 rotates once.

The first reference load unit 60A is provided in the twenty four hour wheel gear 42*a*. Accordingly, in a case where the tooth of the third intermediate hour pinion 34*b* comes into contact with the first reference load unit 60A, the load received by the rotor 22 of the first motor 20A is increased. That is, the first reference load unit 60A causes the load received by the rotor 22 of the first motor 20A to fluctuate once, each time the twenty four hour wheel 42 rotates once. In addition, the twenty four hour wheel 42 rotates once, each time the hour wheel 35 rotates twice. Accordingly, the first reference load unit 60A causes the load received by the rotor 22 of the first motor 20A to fluctuate once, each time the hour hand 6 rotates twice.

The second intermediate hour wheel 33 rotates with respect to the rotor 22 of the first motor 20A at the reduction ratio lower than the reduction ratio of the twenty four hour wheel 42. Therefore, the second reference load unit 60B causes the load received by the rotor 22 of the first motor 20A to fluctuate at a higher frequency than the first reference load unit 60A. In particular, the reduction ratio of the twenty four hour wheel 42 is an integer multiple of the reduction ratio of the second intermediate hour wheel 33. Therefore, the second reference load unit 60B causes the load received by the rotor 22 of the first motor 20A to fluctuate at the frequency which is an integer multiple of the frequency of the first reference load unit 60A.

The twenty four hour wheel gear 42*a* meshes with the intermediate date indicator wheel gear 43*a* in addition to the third intermediate hour pinion 34*b*. Whereas the twenty four hour wheel gear 42*a* is a driven wheel gear with respect to the third intermediate hour pinion 34*b*, the twenty four hour wheel gear 42*a* is a driving wheel gear with respect to the intermediate date indicator wheel gear 43*a*. Therefore, the load fluctuation caused in a case where the tooth of the intermediate date indicator wheel gear 43*a* comes into contact with the first reference load unit 60A is sufficiently smaller than the load fluctuation caused in a case where the tooth of the third intermediate hour pinion 34*b* comes into contact with the first reference load unit 60A. Therefore, the load fluctuation caused by the meshing with the third intermediate hour pinion 34*b* can be determined separately from the load fluctuation caused by the meshing with the intermediate date indicator wheel gear 43*a*.

Moreover, the rotation center of the intermediate date wheel 43 is provided at the position deviated from the straight line passing through the rotation center of the twenty four hour wheel 42 and the rotation center of the third intermediate hour wheel 34 in a plan view. Therefore, based on a relationship between the timing at which the load fluctuation is caused by the meshing with the third intermediate hour pinion 34*b* and the timing at which the load fluctuation is caused by the meshing with the intermediate date indicator wheel gear 43*a*, the load fluctuation caused by the meshing with the third intermediate hour pinion 34*b* can be determined separately from the load fluctuation caused by the meshing with the intermediate date indicator wheel gear 43*a*.

As illustrated in FIG. 2, the reference load units 60 are also provided in two wheel gears in the second train wheel group 50 (only one of the reference load units 60 is illustrated in FIG. 2). In the present embodiment, the reference load unit 60 is provided in each of the center wheel 55*b* and the second wheel 53*b*. The second wheel & pinion 53 rotates with respect to the rotor 22 of the second motor 20B at the reduction ratio lower than the reduction ratio of the center wheel & pinion 55. Therefore, the reference load unit 60 provided in the second wheel & pinion 53 causes the load received by the rotor 22 of the second motor 20B to fluctuate at a higher frequency than the reference load unit 60 provided in the center wheel & pinion 55.

As described above, in the present embodiment, the first train wheel group 30 of the movement 4 includes the twenty four hour wheel gear 42*a* having the first reference load unit 60A disposed to mesh with the third intermediate hour pinion 34*b* so that the load received by the rotor 22 of the first motor 20A fluctuates in a case where the first reference load unit 60A meshes with the third intermediate hour pinion 34*b*, and rotating at the reduction ratio of 720 with respect to the rotor 22 of the first motor 20A, and the second intermediate hour wheel gear 33*a* having the second reference load unit 60B disposed to mesh with the first intermediate hour pinion 32*b* so that the load received by the rotor 22 of the first motor 20A fluctuates in a case where the second reference load unit 60B meshes with the first intermediate hour pinion 32*b*, and rotating at the reduction ratio of 45 with respect to the rotor 22 of the first motor 20A.

According to this configuration, the second intermediate hour wheel gear 33*a* having the second reference load unit 60B rotates more than the twenty four hour wheel gear 42*a* having the first reference load unit 60A, each time the rotor 22 of the first motor 20A rotates one step. Therefore, the frequency at which the second reference load unit 60B meshes with the first intermediate hour pinion 32*b* is higher than the frequency at which the first reference load unit 60A meshes with the third intermediate hour pinion 34*b*. In this manner, the second reference load unit 60B causes the load received by the rotor 22 of the first motor 20A to fluctuate at a higher frequency than the first reference load unit 60A. Here, the reduction ratio of the twenty four hour wheel gear 42*a* is relatively high. Accordingly, in some cases, the first reference load unit 60A may mesh with the third intermediate hour pinion 34*b* over a plurality of steps of the rotation of the rotor 22 of the first motor 20A. In this case, the load received by the rotor 22 of the first motor 20A fluctuates over the plurality of steps of the rotation of the rotor 22 due to the first reference load unit 60A. Accordingly, there is a possibility that the reference position of the hour hand 6 rotating in synchronization with the third intermediate hour pinion 34*b* may be unlikely to be determined by detecting only the load fluctuation caused by the first reference load unit 60A. Therefore, the reference position of the hour hand 6 can be accurately determined by combining a low frequency load fluctuation caused by the first reference load unit 60A with a high frequency load fluctuation caused by the second reference load unit 60B. Therefore, the reference position of the hour hand 6 can be accurately detected.

In addition, the first train wheel group 30 includes the hour wheel 35 to which the hour hand 6 is attached, and which rotates at the reduction ratio of 360 with respect to the rotor 22 of the first motor 20A. The reduction ratio of the twenty four hour wheel gear 42*a* is a multiple of the reduction ratio of the hour wheel 35. According to this configuration, the hour hand 6 can be rotated once, each time the twenty four hour wheel gear 42*a* is rotated by the integer number of rounds. Therefore, the hour hand 6 can be located at the same position every time, at any timing at which the first reference load unit 60A meshes with the third intermediate hour pinion 34*b*. Therefore, the reference position of the hour hand 6 can be accurately determined.

In addition, the reduction ratio of the twenty four hour wheel gear 42*a* is a multiple of the reduction ratio of the second intermediate hour wheel gear 33*a*. According to this configuration, the twenty four hour wheel gear 42*a* can be rotated once, each time the second intermediate hour wheel gear 33*a* is rotated by the integer number of rounds. Therefore, the timing at which the load fluctuation occurs due to the second reference load unit 60B can be fixedly set with respect to the timing at which the load fluctuation occurs due to the first reference load unit 60A. Therefore, the reference position of the hour hand 6 can be easily determined by combining the load fluctuation caused by the first reference load unit 60A with the load fluctuation caused by the second reference load unit 60B.

In addition, the first train wheel group 30 has the hour train wheel 31 that transmits the rotation of the rotor 22 of the first motor 20A to the hour hand 6, and the calendar train wheel 41 that transmits the rotation of the rotor 22 of the first motor 20A to the twenty four hour hand 9 and the date indicator 46. The hour train wheel 31 and the calendar train wheel 41 include the twenty four hour wheel gear 42*a* and the second intermediate hour wheel gear 33*a*. According to this configuration, the wheel gear that transmits the rotation of the rotor 22 of the first motor 20A to at least one of the hour hand 6, the twenty four hour hand 9, and the date indicator 46 can be used as the wheel gear having the first reference load unit 60A and the second reference load unit 60B. Therefore, the movement 4 that achieves the above-described operational effect can be formed without increasing the number of wheel gears.

In addition, the first reference load unit 60A comes into contact with the third intermediate hour pinion 34*b*, and elastically deforms. The second reference load unit 60B comes into contact with the first intermediate hour pinion 32*b*, and elastically deforms. According to this configuration, the first reference load unit 60A comes into contact with the third intermediate hour pinion 34*b*, and elastically deforms. Accordingly, energy loss occurs in the first train wheel group 30 due to the elastic deformation. In addition, the second reference load unit 60B comes into contact with the first intermediate hour pinion 32*b*, and elastically deforms. Accordingly, the energy loss occurs in the first train wheel group 30 due to the elastic deformation. The energy loss occurs in the first train wheel group 30, thereby increasing the load received by the rotor 22 of the first motor 20A. Therefore, it is possible to form the first reference load unit 60A and the second reference load unit 60B which cause the load received by the rotor 22 of the first motor 20A to fluctuate.

Then, the timepiece 1 according to the present embodiment includes the above-described movement 4. Accordingly, it is possible to provide the timepiece which can accurately recognize the position of the hour hand 6.

In the above description, the operational effect of the first reference load unit 60A and the second reference load unit 60B in the first train wheel group 30 has been described. However, a pair of reference load units 60 in the second train wheel group 50 also achieves the same operational effect. That is, the second wheel 53*b* and the center wheel 55*b* each have the reference load unit 60. Accordingly, the reference positions of the minute hand 7 and the second hand 8 can be accurately determined, based on the fluctuation in the load received by the rotor 22 of the second motor 20B.

Second Embodiment

Figure 7:
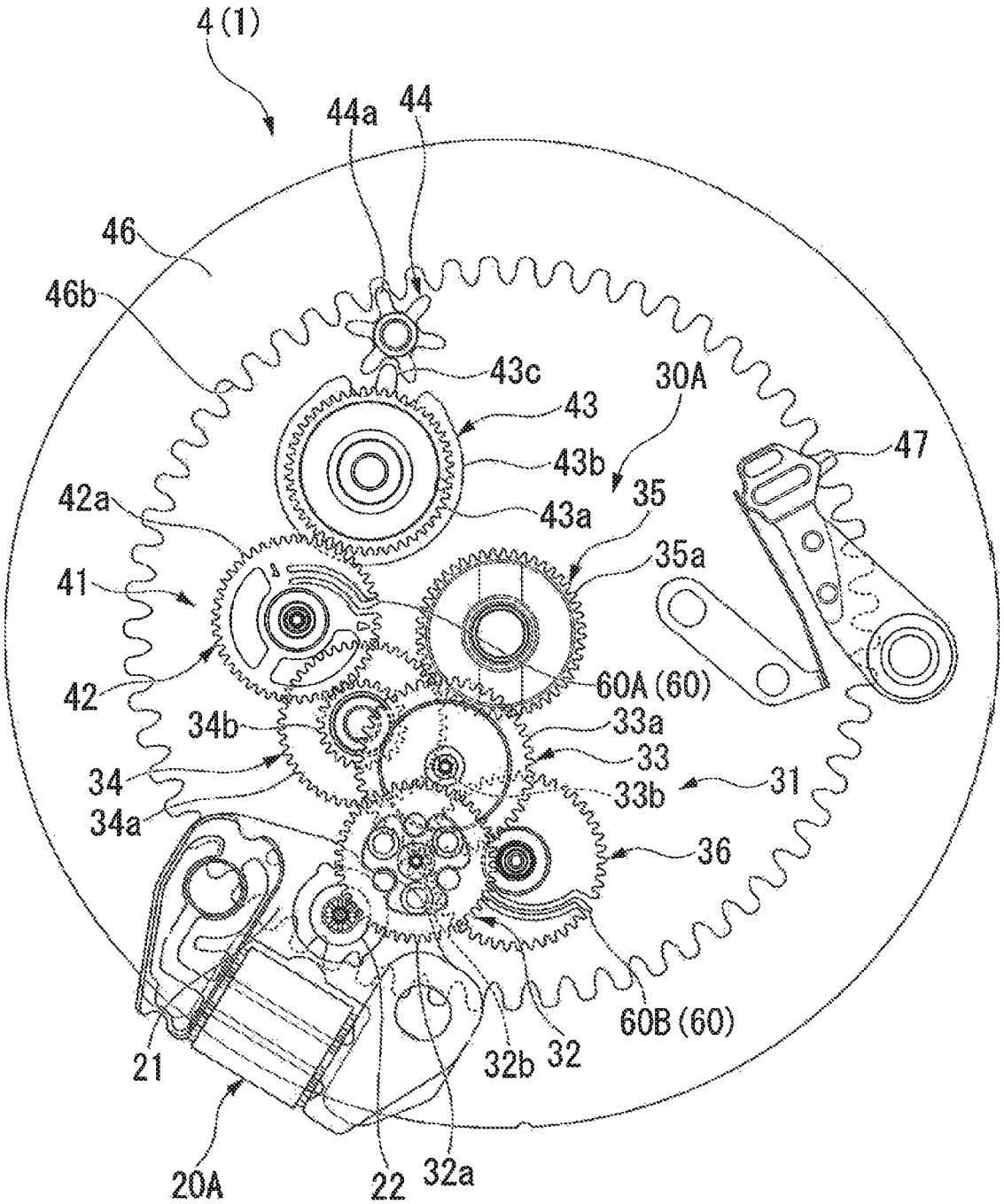
FIG. 7 is a plan view illustrating a part of a movement according to a second embodiment, and is a view when a first train wheel group is viewed from the front side.

FIG. 7 is a plan view illustrating a part of a movement according to a second embodiment, and is a view when a first train wheel group is viewed from the front side.

In the first embodiment illustrated in FIG. 5, both the first reference load unit 60A and the second reference load unit 60B are provided in wheel gears of at least one of the hour train wheel 31 and the calendar train wheel 41. In contrast, the second embodiment illustrated in FIG. 7 is different from the first embodiment in that the second reference load unit 60B is provided in a wheel gear different from that of the hour train wheel 31 and the calendar train wheel 41. Configurations other than those described below are the same as those according to the first embodiment.

As illustrated in FIG. 7, a first train wheel group 30A according to the present embodiment has a configuration as follows. A dedicated wheel gear 36 is added to the first train wheel group 30 according to the first embodiment, and the second reference load unit 60B is provided in the dedicated wheel gear 36 instead of the second intermediate hour wheel gear 33*a*. The dedicated wheel gear 36 meshes with only the first intermediate hour pinion 32*b* of the first intermediate hour wheel 32. The dedicated wheel gear 36 is a driven wheel gear with respect to the first intermediate hour wheel 32. The dedicated wheel gear 36 is disposed on a path which does not transmit a torque to any of the hour hand 6, the twenty four hour hand 9, and the date indicator 46 among torque transmission paths of the rotor 22 of the first motor 20A in the first train wheel group 30A. The dedicated wheel gear 36 rotates at the reduction ratio of 7.5 with respect to the first intermediate hour wheel 32. That is, the dedicated wheel gear 36 rotates at the reduction ratio of 45 with respect to the rotor 22 of the first motor 20A.

As described above, the dedicated wheel gear 36 has the second reference load unit 60B. Therefore, as in the second intermediate hour wheel gear 33*a* according to the first embodiment, the second reference load unit 60B causes the load received by the rotor 22 of the first motor 20A to fluctuate once, each time the dedicated wheel gear 36 rotates once. Then, the dedicated wheel gear 36 rotates with respect to the rotor 22 of the first motor 20A at the reduction ratio lower than the reduction ratio of the twenty four hour wheel 42. Therefore, the second reference load unit 60B causes the load received by the rotor 22 of the first motor 20A to fluctuate at a higher frequency than the first reference load unit 60A. Particularly, the reduction ratio of the twenty four hour wheel 42 is an integer multiple of the reduction ratio of the dedicated wheel gear 36. Therefore, the second reference load unit 60B causes the load received by the rotor 22 of the first motor 20A to fluctuate at the frequency which is an integer multiple of the frequency of the first reference load unit 60A.

As described above, in the present embodiment, the first train wheel group 30A of the movement 4 includes the twenty four hour wheel gear 42*a* having the first reference load unit 60A, and the dedicated wheel gear 36 having the second reference load unit 60B. Accordingly, the same operational effect as that according to the first embodiment can be achieved.

In addition, the dedicated wheel gear 36 is provided separately from the wheel gears included in the hour train wheel 31 and the calendar train wheel 41. According to this configuration, the dedicated wheel gear 36 is provided separately from the wheel gear that transmits the rotation of the rotor 22 of the first motor 20A to at least one of the hour hand 6, the twenty four hour hand 9, and the date indicator 46. Accordingly, the movement 4 that achieves the above-described operational effect can be formed without changing the configuration of the train wheel in the related art.

Third Embodiment

Figure 8:
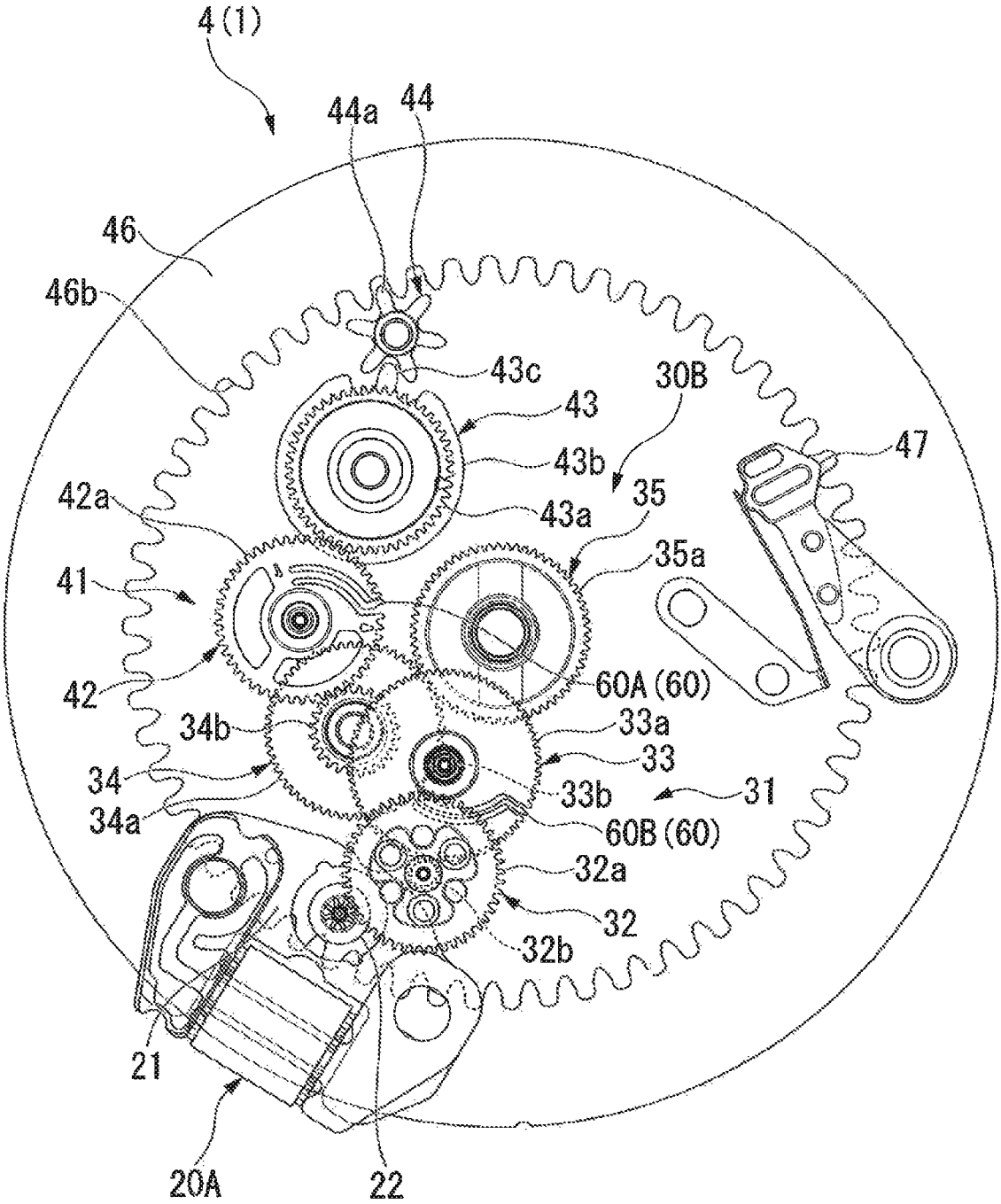
FIG. 8 is a plan view illustrating a part of a movement according to a third embodiment, and is a view when a first train wheel group is viewed from the front side.

FIG. 8 is a plan view illustrating a part of a movement according to a third embodiment, and is a view when a first train wheel group is viewed from the front side.

The third embodiment illustrated in FIG. 8 is different from the first embodiment in that the second intermediate hour wheel 33 rotates at the reduction ratio of 36 with respect to the rotor 22 of the first motor 20A. Configurations other than those described below are the same as those according to the first embodiment.

As illustrated in FIG. 8, a first train wheel group 30B according to the present embodiment changes the reduction ratio of the second intermediate hour wheel 33 with respect to the rotor 22 of the first motor 20A, compared to the first train wheel group 30 according to the first embodiment. The number of teeth of the second intermediate hour wheel gear 33*a* of the second intermediate hour wheel 33 is 72. The second intermediate hour wheel 33 rotates at the reduction ratio of 6 with respect to the first intermediate hour wheel 32. That is, the second intermediate hour wheel 33 rotates at the reduction ratio of 36 with respect to the rotor 22 of the first motor 20A. The third intermediate hour wheel 34 rotates at the reduction ratio of 10 with respect to the second intermediate hour wheel 33. That is, the third intermediate hour wheel 34 rotates at the reduction ratio of 360 with respect to the rotor 22 of the first motor 20A.

In the present embodiment, the rotor 22 of the first motor 20A has two magnetic poles. Therefore, the number of steps of the first motor 20A which is required for rotating the second intermediate hour wheel gear 33*a* having the second reference load unit 60B once is 72 equal to the number of teeth of the second intermediate hour wheel gear 33*a*.

According to the present embodiment, a period during which the second reference load unit 60B meshes with the first intermediate hour pinion 32*b* so that the load received by the rotor 22 fluctuates is a period of approximately one step of the first motor 20A. In this manner, the second reference load unit 60B causes the load fluctuation to occur for only a period of approximately one step of the first motor 20A, while the second intermediate hour wheel gear 33*a* rotates once. Therefore, the reference position of the hour hand 6 can be more accurately determined, compared to the configuration in which the reference load unit causes the load fluctuation to occur over a period of the plurality of steps of the first motor 20A. In addition, it is possible to more freely adopt a train wheel configuration.

The present invention is not limited to the embodiments described above with reference to the drawings, and it is conceivable to adopt various modification examples within the technical scope of the present invention.

For example, in the above-described embodiment, the reference load units 60 are provided in the second intermediate hour wheel gear 33*a* and the twenty four hour wheel gear 42*a* in the first train wheel group 30. However, the reference load unit may be provided in the other wheel gear. However, it is desirable that the reference load unit is provided in the wheel gear on the driven side of the pair of wheel gears meshing with each other. In this manner, the load received by the rotor 22 can be increased, compared to a configuration in which the reference load unit is provided in the wheel gear on the driving side.

In addition, in the above-described embodiment, the first reference load unit 60A is provided in the wheel gear included in the calendar train wheel 41. However, the first reference load unit 60A may be provided in the wheel gear which is not included in the hour train wheel 31 and the calendar train wheel 41.

In addition, in the above-described embodiment, the reference load unit 60 is formed in such a manner that one tooth of the wheel gear is elastically displaceable. However, the present invention is not limited thereto. For example, the reference load unit may be formed in such a manner that one tooth of the wheel gear has a shape different from a shape of other teeth.

In addition, in the above-described embodiment, the date indicator 46 has been described as an example of the display wheel for displaying information. However, the display wheel is not limited to the date indicator 46. For example, a day indicator for displaying the day of the week as the information may be applied as the display wheel.

Alternatively, configuration elements in the above-described embodiments can be appropriately substituted with known configuration elements within the scope not departing from the concept of the present invention, and the above-described respective embodiments may be appropriately combined with each other.

What is claimed is:

1. A timepiece movement comprising:

at least one drive unit each having a stepping motor configured to rotate a rotor to thereby move an indicating hand; and a train wheel group having wheel gears rotated by rotation of the rotor, wherein the train wheel group includes a first wheel gear, a second wheel gear, a third wheel gear having a plurality of third wheel teeth engaged with the first wheel gear and driven thereby to rotate at a first reduction ratio with respect to the rotation of the rotor, the third wheel teeth having at least one elastic third wheel tooth so that each time the at least one elastic third wheel tooth engages with the first wheel gear at an interval determinable by the first reduction ratio, the at least one elastic third wheel tooth increases a load on the at least one drive unit, and a fourth wheel gear having a plurality of fourth wheel teeth engaged with the second wheel gear and driven thereby to rotate at a first reduction ratio, different from the first reduction rate, with respect to the rotation of the rotor, the fourth wheel teeth having at least one elastic fourth wheel tooth so that each time the at least one elastic fourth wheel tooth engages with the second wheel gear at an interval determinable by the second reduction ratio, the at least one elastic fourth wheel tooth increases a load on the at least one drive unit.

2. The timepiece movement according to claim 1, wherein the train wheel group has a fifth wheel attached with the indicating hand and driven to rotate at a third reduction ratio with respect to the rotation of the rotor, and wherein the first reduction ratio is equal to a multiple of the third reduction ratio multiplied by an integer.

3. The timepiece movement according to claim 1, wherein the first reduction ratio is equal to the second reduction ratio multiplied by an integer.

4. The timepiece movement according to claim 1, wherein a number of steps of the stepping motor which is required to make one rotation of the fourth wheel gear is equal to a number of the fourth wheel teeth.

5. The timepiece movement according to claim 1, wherein the tram wheel group has a train of wheels for transmitting the rotation of the rotor to at least one of the indicating hand or a display wheel for displaying information, and wherein the first train of wheels includes the third wheel gear and the fourth wheel gear.

6. The timepiece movement according to claim 1, wherein the train wheel group has a train of wheels for transmitting the rotation of the rotor to at least one of the indicating hand or a display wheel for displaying information, and wherein at least one of the third wheel gear or the fourth wheel gear is not included in the train wheel.

7. The timepiece movement according to claim 1, wherein the at least one elastic third wheel tooth elastically deforms by coming into contact with the first wheel gear, and wherein the at least one elastic fourth wheel tooth elastically deforms by coming into contact with the second wheel gear.

8. A timepiece comprising the time piece movement according to claim 1.

* * * * *